United States Patent [19]

Wilkens

[11] Patent Number: 4,896,803

[45] Date of Patent: Jan. 30, 1990

[54] PULLING ON AID FOR COMPRESSION STOCKINGS

[76] Inventor: Claus-Dieter Wilkens, Nauheimer Strasse 35, D-2800 Bremen 44, Fed. Rep. of Germany

[21] Appl. No.: 323,394

[22] Filed: Mar. 14, 1989

[30] Foreign Application Priority Data

Mar. 15, 1988 [DE] Fed. Rep. of Germany ..... 3808557
Mar. 25, 1988 [DE] Fed. Rep. of Germany ..... 3810047

[51] Int. Cl.[4] ..... A47G 25/90
[52] U.S. Cl. ..... 223/112; 223/117
[58] Field of Search ..... 223/112, 119, 75, 60, 223/117, 115

[56] References Cited

U.S. PATENT DOCUMENTS 2,982,453 5/1961 Zicarelli ..... 223/112

*Primary Examiner*—Werner H. Schroeder
*Assistant Examiner*—Jodi A. Tokar
*Attorney, Agent, or Firm*—Hill, Van Santen, Steadman & Simpson

[57] ABSTRACT

Putting on aid for putting on stockings, particularly compression stockings, characterized by a frame-like construction with at least four substantially equidistantly spaced, parallel-extending support rods (10,12,14,16) whereof first ends are interconnected by means of a first clip (18) and whereof the second ends are interconnected by means of a second clip (20), the first substantially semicircular clip (18) with a diameter corresponding to the stocking width and the substantially U-shaped second clip (20) with a significantly greater width being interconnected.

6 Claims, 1 Drawing Sheet

PULLING ON AID FOR COMPRESSION STOCKINGS

The invention relates to a pulling or putting on aid for pulling or putting on stockings, particularly compression stockings.

Considerable difficulties are encountered in putting on compression stockings, no matter whether they have an open or closed foot tip or toe. Due to the strong, desired gripping effect of the stockings, particularly in the foot region, it is essentially only possible to "roll up" the stockings after they have previously been turned to the "left". This process involves a lot of effort.

Hitherto attempts have been made to use under-stockings as a sliding aid, but they suffer from the disadvantage that they have to be removed again after putting on the compression stockings, so that it is only possible to use them in the case of compression stockings with an open toe.

The problem of the invention is to provide a putting on aid for putting on stockings, particularly compression stockings.

According to the invention the problem is solved by a frame-like construction with at least four substantially equidistantly spaced, parallel-extending support rods whereof first ends are interconnected by means of a first clip and whereof the second ends are interconnected by means of a second clip, the first substantially semicircular clip with a diameter corresponding to the stocking width and the substantially U-shaped second clip with a significantly greater width being interconnected.

A preferred embodiment is characterized in that the plans of the two clips are substantially at right angles to the extension of the support rods. Preference is given to a construction in which the support rods are L-shaped. It is also proposed that the support rods are longitudinally adjustable.

A preferred embodiment is characterized by a pair of gripping rods attached to the second clip and running substantially parallel to the L-shaped support rods. These gripping rods can be bent outwards on the upper portion thereof.

Figure 1:
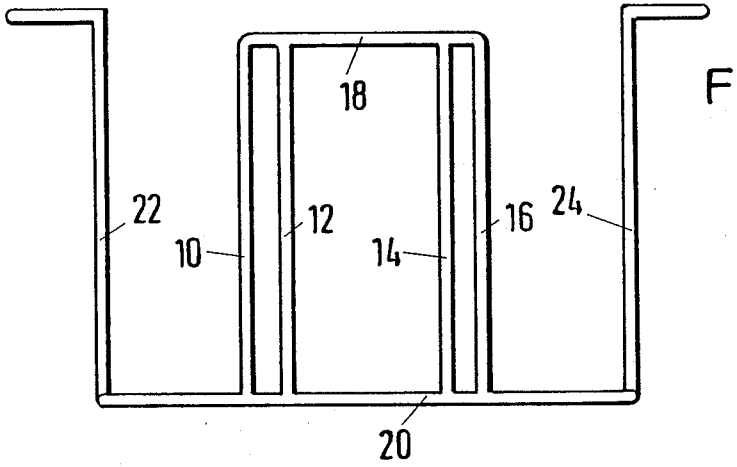

Further features and advantages of the invention can be gathered from the description of a non-limitative embodiment and the attached drawings, wherein show:

FIG. 1 a front view of the pulling on aid.

Figure 2:
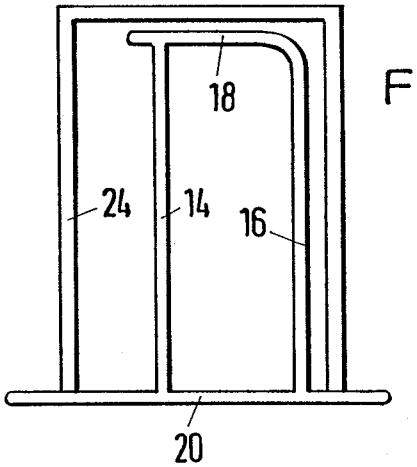

FIG. 2 a side view of the pulling on aid.

Figure 3:
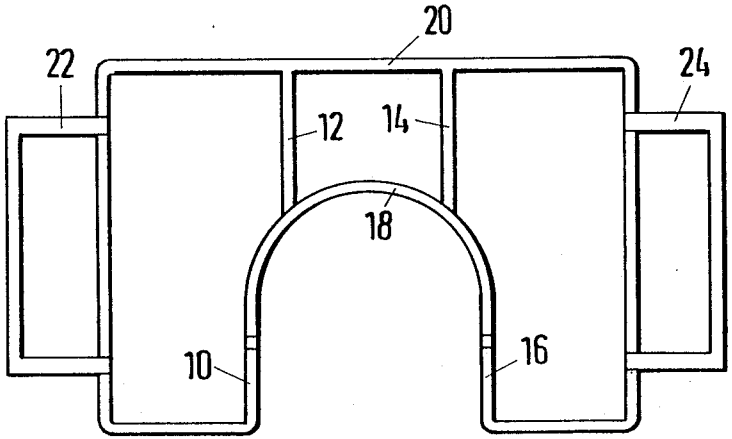

FIG. 3 a plan view of the pulling on aid.

The pulling or putting on aid comprises four L-shaped support rods or struts 10,12,14,16, whose vertical legs are substantially parallel to one another and whose horizontal legs are directed away from one another pairwise in a common plane.

The free ends of the vertical legs of the L-shaped support rods 10,12,14,16 are interconnected by means of a roughly semicircular, first clip 18, whose diameter roughly corresponds to the width of the stocking to be put on. The free ends of the horizontal legs of the L-shaped support rods 10,12,14,16 are interconnected by means of a U-shaped second clip 20, whose width is significantly greater than the width of the first clip 18.

First clip 18 and second clip 20 in each case run in a plane which is at right angles to the support rods 10, 12,14,16 and therefore parallel to one another.

Thus, together with the first clip 18, the vertical legs of the L-shaped support rods form a half-shell structure, whilst the horizontal legs of the L-shaped rods 10,12,14,16 together with the second clip 20 form a base frame.

The putting on aid can be made from plastic, steel-wire or the like.

Prior to use, the putting on aid is placed on a substrate, such as a table. The compression stocking with the toe in the interior of the "half-shell structure" of the putting on aid is rolled outwards over the half-shell structure until only the foot region is within the sleeve. The foot is then inserted in the foot part of the compression stocking and then the device is gripped laterally with the hands, whilst gripping through the spacing between the vertical legs of the L-shaped rods 10,12 or 14,16 for grasping the stockings, which can then be moved upwards for rolling the stockings up the leg.

The reciprocal spacing of rods 10,12 or 14,16 is chosen in such a way that at least two and preferably three fingers can pass through, so as to adequately grip and roll up the edge of the stocking. The spacing of the two inner rods 12,14 is sufficiently large to enable the heel of the user to be passed between them. The spacing between the two outer rods 10,16 corresponding to the diameter of the first clip 18 is adapted to the stocking width and consequently corresponds to the width of the lower leg of the user.

An embodiment in which the vertical legs of support rods 10,12,14 is longitudinally adjustable, e.g. telescopic is not shown in the drawings.

The construction of the lower clip 20 forming a base frame together with the horizontal legs of the L-shaped rods 10,12,14,16 is not critical, because it merely serves to interconnect the lower ends of rods 10,12,14,16 for increasing stability and permit a setting up of the putting on aid for applying the stocking in question.

The spacing of the support rods from one another and the diameter of the first clip are otherwise a function of the width of the stocking to be put on.

In the represented embodiment the putting on aid is also provided with a pair of gripping rods 22,24 attached to the lateral portions of the second clip 20 and which are substantially parallel to the L-shaped rods 10,12,14,16. The upper end portion of the gripping rods is bent outwards. When providing such gripping rods, whose length is not critical, but which are preferably somewhat longer than rods 10,12,14,16, it is made even easier to put on the compression stockings.

The inventive features disclosed in the description, drawings and claims can be essential to the realisation of the different embodiments of the invention, either singly or in the form of random combinations.

I claim:

1. Putting on aid for putting on stockings, particularly compression stockings, comprising a frame-like construction with at least four substantially equidistantly spaced, parallel-extending support rods (10,12,14,16) whereof first ends are interconnected by means of a first clip (18) and whereof the second ends are interconnected by means of a second clip (20), the first clip (18) being substantially semicircular with a diameter corresponding to the stocking width and the second clip (20) being substantially U-shaped with a significantly greater width being interconnected with the first clip.

2. Putting on aid according to claim 1, wherein the planes of the two clips (18,20) are substantially at right angles to the extension of support rods (10,12,14,16).

3: Putting on aid according to claims 1 or 2, wherein the support rods (10,12,14,16) are L-shaped.

4. Putting on aid according to claims 1 or 2, wherein that the support rods (10,12,14,16) are longitudinally adjustable.

5. Putting on aid according to claim 1 comprising a pair of gripping rods (22,24) attached to the lateral portions of the second clip (20) and which are substantially parallel to the L-shaped rods (10,12,14,16).

6. Putting on aid according to claim 5, wherein the upper end portion of each gripping rods (22,24) is bent outwardly.

* * * * *